US010344480B2

(12) United States Patent
Azizinamini

(10) Patent No.: US 10,344,480 B2
(45) Date of Patent: Jul. 9, 2019

(54) COMPOSITE CONSTRUCT AND METHODS AND DEVICES FOR MANUFACTURING THE SAME

(71) Applicant: Atorod Azizinamini, Miramar, FL (US)

(72) Inventor: Atorod Azizinamini, Miramar, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 16/202,318

(22) Filed: Nov. 28, 2018

(65) Prior Publication Data

US 2019/0169846 A1 Jun. 6, 2019

Related U.S. Application Data

(60) Provisional application No. 62/632,007, filed on Feb. 19, 2018, provisional application No. 62/594,303, filed on Dec. 4, 2017.

(51) Int. Cl.

| | |
|---|---|
| ***E04C 3/34*** | (2006.01) |
| ***E04C 3/44*** | (2006.01) |
| ***E01D 19/02*** | (2006.01) |
| ***E04G 13/04*** | (2006.01) |
| ***E04G 13/02*** | (2006.01) |

(52) U.S. Cl.
CPC ..... *E04C 3/34* (2013.01); *E01D 19/02* (2013.01); *E04C 3/44* (2013.01); *E04G 13/021* (2013.01); *E04G 13/04* (2013.01)

(58) Field of Classification Search
CPC . E04C 3/34; E04C 3/44; E04G 13/021; E04G 13/04; E01D 19/02
See application file for complete search history.

(56) References Cited

U.S. PATENT DOCUMENTS

| | | | | |
|---|---|---|---|---|
| 1,065,529 A * | 6/1913 | Jones | E04C 3/34 52/270 |
| 2007/0028541 A1* | 2/2007 | Pasek | B28B 19/0046 52/250 |
| 2011/0265403 A1* | 11/2011 | Kim | E04B 1/21 52/223.5 |

* cited by examiner

*Primary Examiner* — Patrick J Maestri
(74) *Attorney, Agent, or Firm* — Saliwanchik, Lloyd & Eisenschenk

(57) ABSTRACT

Methods for manufacturing a composite concrete structure are provided. A method can include utilizing a shell formwork with a displacement piece positioned therein. A first type of concrete can be placed in the shell formwork around the displacement piece. The displacement piece, when removed, leaves a void that is fillable with a second type of concrete for form the composite concrete structure. A reinforcement cage or reinforcement rods can be incorporated into the void prior to placement of the second type of concrete.

20 Claims, 15 Drawing Sheets

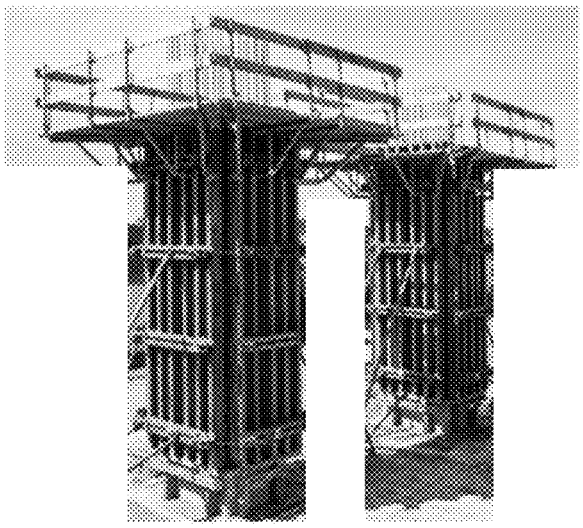
FIG. 8
FIG. 9A
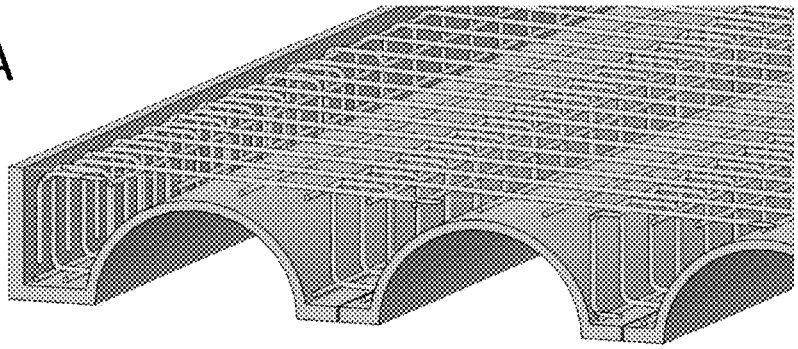
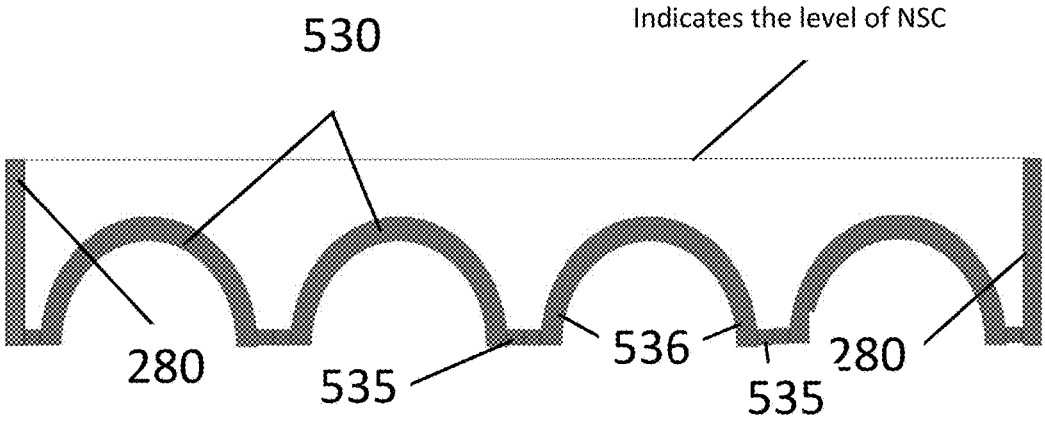
FIG. 9B

FIG. 11C
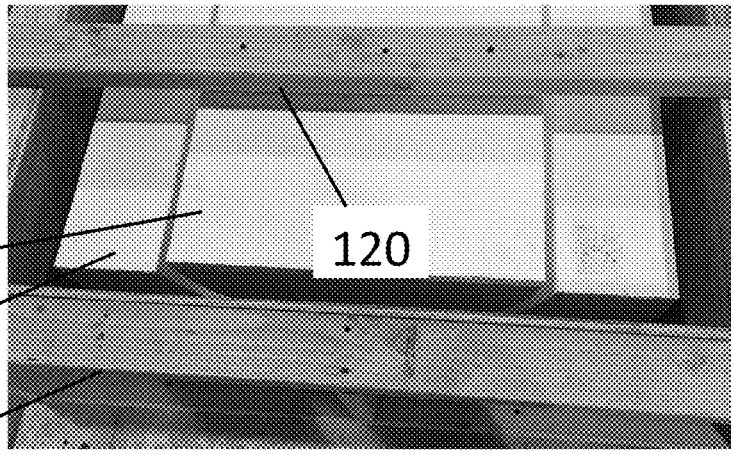
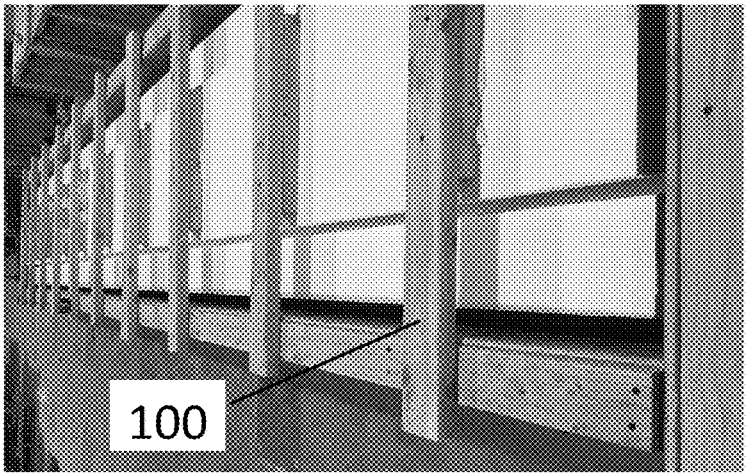
FIG. 11D
FIG. 11E
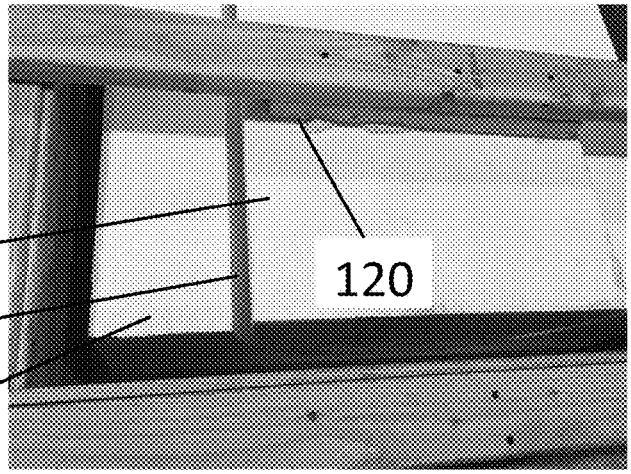

End of loading
Cracking at 50 Kips
Cracking at 15 Kips

End of loading
Cracking at 80 Kips
Cracking at 30 Kips

COMPOSITE CONSTRUCT AND METHODS AND DEVICES FOR MANUFACTURING THE SAME

CROSS-REFERENCE TO RELATED APPLICATIONS

This application claims the benefit of U.S. Provisional Application Ser. No. 62/632,007, filed Feb. 19, 2018 and U.S. Provisional Application Ser. No. 62/594,303, filed Dec. 4, 2017, the disclosures of which are hereby incorporated by reference in their entireties, including all figures, tables and drawings.

This invention was made with government support under Grant No. DTRT13-G-UTC41 awarded by the U.S. Department of Transportation. The government has certain rights in the invention.

BACKGROUND OF INVENTION

The concrete beams and other concrete elements used for large constructions, such as buildings or bridges, are typically manufactured on-site of a construction project. This requires building formworks, i.e., molds, from steel, wood or other materials, which are filled with normal strength concrete (NSC). After the NSC has cured and obtained the required strength, the formwork must be removed. The removal of the formwork is time-consuming and expensive. Furthermore, because of the weight and size of the final concrete element, transport can be difficult, costly, and time-consuming.

BRIEF SUMMARY

The subject invention provides devices and methods that address the problem of on-site manufacture of beams that require a removable formwork. In one embodiment, the subject invention provides methods for forming a shell, with a void, that can be used in place of a typical formwork to manufacture a final concrete construct. The shell can be cast in a shell formwork or formed by additive manufacturing (3D printing) techniques using a first type of concrete, such as, for example, an Ultra-High Performance Concrete (UHPC). A second type of concrete, such as Normal Strength Concrete (NSC), can be placed in a void formed in the UHPC shell. Advantageously, the second type of concrete can be placed in the void on-site of a construction project. A further advantage is that the NSC incorporates the UHPC shell into a final concrete construct, eliminating the need to remove formwork after the NSC has cured.

Advantageously, the shell has considerably less weight than a standard concrete element. This allows a shell to be constructed off-site and more easily transported on-site for final deposit therein of the NSC. This can accelerate construction time and is less expensive than constructing multiple formworks on-site, which are removed after the concrete cures. The UHPC shell is also exceptionally durable and moisture-resistant, which provides a longer-lasting structure.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention.

FIG. 8 is a photograph of the formwork used to manufacture a column. As seen, the formwork surrounds and contains the normal strength concrete (NSC) until the concrete element has set to the necessary strength for transport. The concrete element in these formworks would be large and heavy to transport.

FIG. 9A illustrates an embodiment of a UHPC shell of short-span bridge arch units. The shell is shown with a reinforcement cage installed prior to filling with NSC.

FIG. 9B is a an illustration of an embodiment of a short-span bridge constructed of arch units joined together to form a void in which NSC can be deposited to form a composite construct.

FIG. 10A shows the displacement pieces for an arch unit positioned in a formwork for the deposit of UHPC. FIG. 10B shows a plurality of UHPC arch shells side-by side with normal strength concrete (NSC) deposited over the arch shells. FIG. 10C shows two arch units side-by-side. FIGS. 9A and 10D show UHPC arch units joined to form a shell. The end arch units can be formed with vertical walls to contain the NSC. FIG. 10E is an enlarged view of the lips on an arch unit with profiles that can form a plug when concrete is deposited between he profiles.

FIGS. 11A-11E show different components and stages for the formation of an arch unit. FIGS. 11A and 11B show the arch unit displacement pieces. FIG. 11C shows the arch unit displacement pieces arranged in a formwork, with the center piece above the bow piece so that the final arch unit has an open end. FIG. 11D shows a formwork with displacement pieces therein. FIG. 11E shows the arch unit displacement pieces arranged in a formwork with the center piece below the bow piece so that the final arch unit has a closed end.

DETAILED DISCLOSURE

Figure 1:
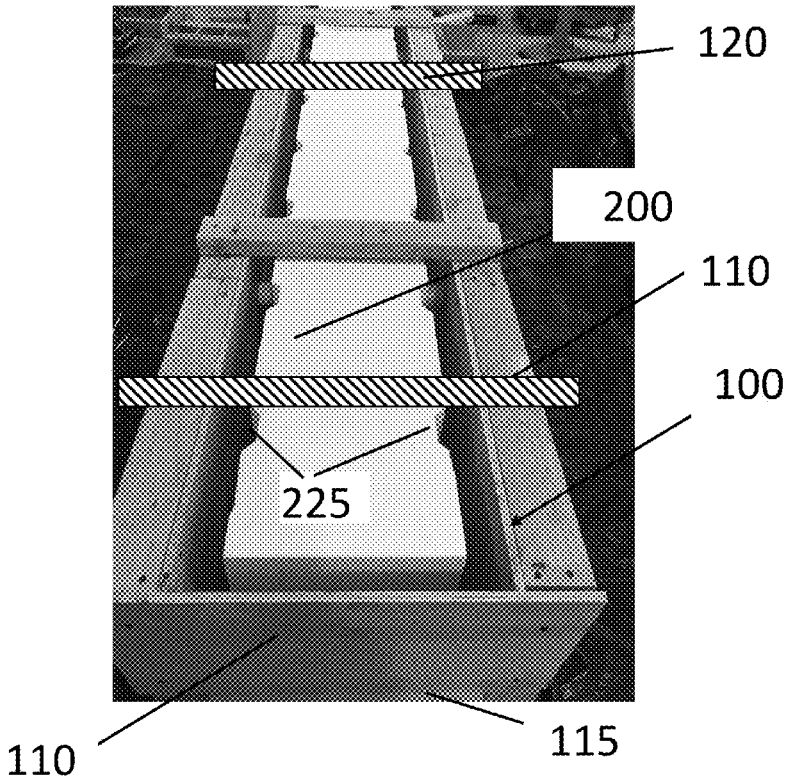
FIG. 1 is photograph showing formwork used to manufacture an Ultra-High Performance Concrete shell for a beam, according to the subject invention. As seen here, a displacement piece is employed to create the internal chamber for receiving normal strength concrete (NSC) that fills the shell.

The subject invention pertains to devices and methods for manufacturing concrete constructs that can be used in construction of buildings, bridges, and other objects. More specifically, the subject invention provides embodiments of composite concrete beams and other building elements that are more efficient and less expensive to manufacture on-site than standard formwork-cured concrete beams.

The subject invention is particularly useful in the field of bridge construction, particularly the manufacture of concrete beams, columns, and arches used in bridge construction. This does not preclude the methods and devices of the subject invention being utilized for other related purposes or other types of composite constructs, as would be apparent to a person with skill in the art and having benefit of the subject disclosure. Variations of the subject invention that provide the same functionality, in substantially the way as described herein, with substantially the same desired results, are within the scope of this invention.

The figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required to implement the present invention. However, because such elements are well known in the art, and because they do not facilitate a better understanding of the present invention, a discussion of such elements is not provided herein.

The present invention is more particularly described in the following examples that are intended to be illustrative only because numerous modifications and variations therein will be apparent to those skilled in the art. As used in the specification and in the claims, the singular for "a," "an" and "the" include plural referents unless the context clearly dictates otherwise.

Reference will be made to the attached Figures on which the same reference numerals are used throughout to indicate the same or similar components. With reference to the attached Figures, which show certain embodiments of the subject invention, it can be seen in FIG. 1 that a shell formwork 100 of the subject invention comprises walls 110 and can comprise a base 115 that together create a receptacle structure for holding and curing a first type of concrete. Within the shell formwork, one or more 100 a displacement pieces 200 can be positioned, around which the first type of concrete is deposited to create a shell with one or more voids 120. After the shell has hardened or cured, the shell formwork and the displacement piece(s) can be removed and a second type of concrete can be deposited to fill the void(s) to form a core 400 in the shell. After the second type of concrete has cured within the shell of the first type of concrete, there is a composite construct 500 comprising the outer shell of the first concrete fused with or joined to the inner core of a second concrete. In a specific embodiment of a concrete construct, the outside shell is cast of Ultra-High Performance Concrete (UHPC) that incorporated with a Normal Strength Concrete (NSC) core, such as concrete formed with Portland cement, 400 on the inside.

Figure 5:
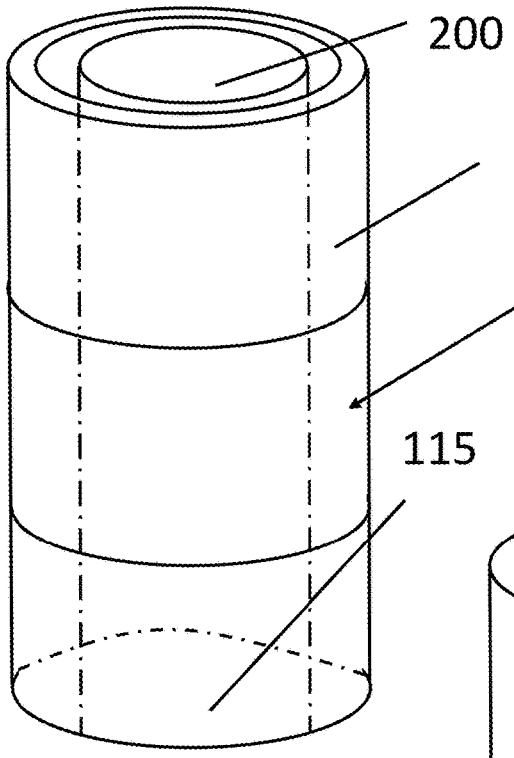
FIG. 5 is an illustration of an alternative embodiment of a shell formwork for manufacturing a columnar-shaped composite construct. Shown here is the shell formwork with a displacement piece in position prior to placement of UHPC in the void.

In FIGS. 1 and 5, it can be seen that a shell formwork 100 provides a reinforced structure in which the first type of concrete, such as, for example, UHPC, can be deposited and which maintains the shape or form of the desired cast construct. In one embodiment, a shell formwork is constructed for casting a shell for a beam-shaped construct, which would have at least 2 flat sides, such as shown in FIGS. 1 and 11C-11E. In another embodiment, a shell formwork is constructed for casting a the shape of a columnar construct, which has an elongate tubular-like form, such as shown in FIGS. 5 and 8. In yet another embodiment, a shell formwork is constructed for casting an arch unit, of the type typically used for constructing short-span bridges. A shell formwork can be constructed of any of a variety of one or more materials, such as, for example wood or wood-composite materials, as shown in FIG. 1 or of wood and aluminum sheets, as shown in FIG. 5 or combinations thereof, as shown in FIG. 8. A shell formwork can be constructed of any of a variety of materials, known to those with skill in the art, and the shell formwork of the subject invention is not limited to any particular materials or shape.

Figure 2:
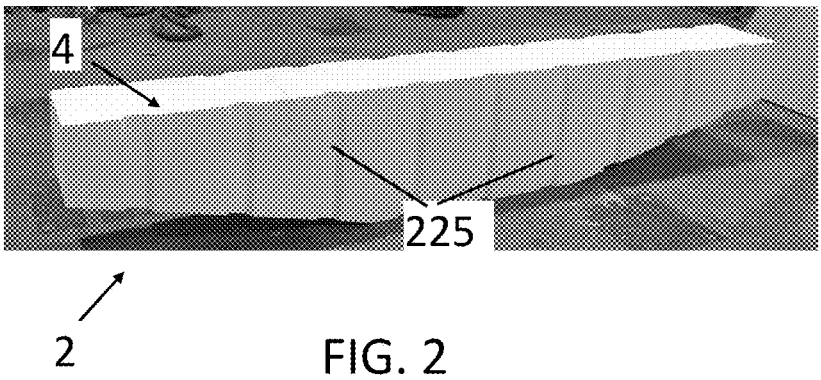
FIG. 2 is a photograph showing one embodiment of a displacement piece that is a foam structure that can be placed in a formwork, such as shown in FIG. 1, to form the internal chamber.
Figure 11A:
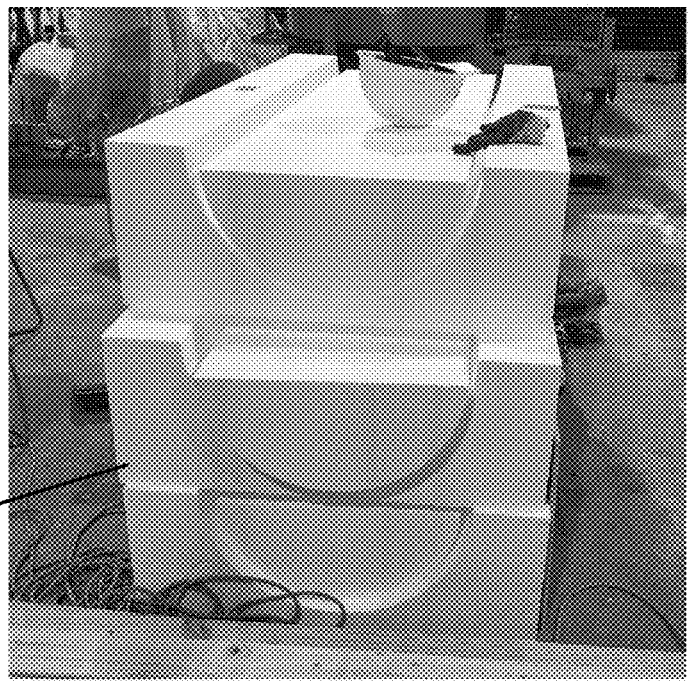
Figure 11B:
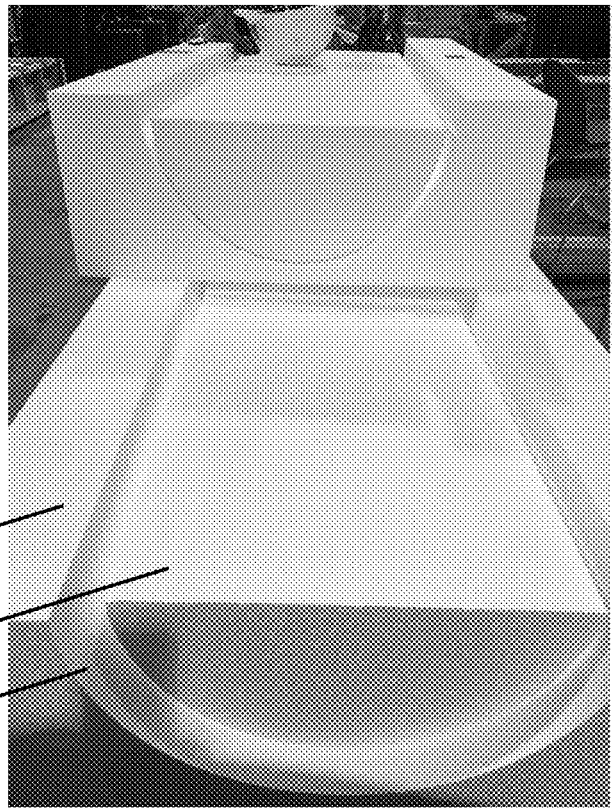

FIGS. 1, 5, 11C and 11E show non-limiting examples of displacement pieces 200 positioned within a shell formwork 100 for displacing UHPC deposited in the shell formwork, so it surrounds at least part of the displacement piece. FIG. 2 illustrates an example of a displacement piece with a semi-circular or curved bottom side 2 and flat top side 4, which can form a UHPC shell 300 with a similarly-shaped void 310. FIG. 5 illustrates an example of a columnar-shaped displacement piece for use in a shell formwork for casting a column. FIGS. 11A and 11B illustrate an example of arch-shaped displacement pieces that are used together to cast an arch-shaped shell for forming an arch unit concrete construct. A displacement piece 200 can assume any of a variety of shapes as necessary to create the void 120. The shape and dimensions of the displacement piece are preferably such that sufficient thickness of UHPC can cure between the displacement pieces 200 and/or the shell formwork 100 to form the UHPC shell 300, such as shown, for example, in FIGS. 3 and 6. The UHPC shell should have sufficient strength to support the uncured second type of concrete 25 placed in the void while it cures. The cured second type of concrete, such as, for example, Normal Strength Concrete (NSC) in the void will form a core 400 inside the shell.

Preferably, the displacement piece 200 is fixed in place within the shell formwork to inhibit movement when UHPC is deposited in the shell formwork and around the displacement piece. In one embodiment, a positioning apparatus 120 is used to secure the position of the displacement piece. FIGS. 1, 11C, and 11E show examples of positioning apparatuses connected to the formwork to secure the foam displacement piece(s) in the formwork. Other types of positioning apparatuses can be used depending on the configuration, material, shape of a displacement piece, and other factors known to those with skill in the art. The subject invention is not limited by the type of positioning apparatus or other apparatuses that may be utilized to secure a displacement piece.

In one embodiment, as the NSC cures in the void 310, an attachment will be formed at the interface 390 between the UHPC shell and NSC core, such that the UHPC shell 300 and the NSC core 400 are joined together or fuse to form a solid composite construct 500. The NSC core should be firmly positioned and tightly held within the UHPC shell. It can be helpful to increase the surface area of the point of interface 390, which can enhance and strengthen the fusion of the UHPC shell with the NSC core.

In one embodiment, the void 310 of the UHPC shell has an irregular, rough, or non-smooth surface around and to which the NSC can embed and integrate or otherwise fuse to secure itself within the shell. In a further embodiment, the displacement piece 200 includes a plurality of surface features 225 that can increase the surface area of the displacement piece, thereby increasing the surface area of the void surface, which increases contact with the NSC. Surface features can be any of a variety of indentations or raised areas that impart to the surface of the displacement piece a bumpy, ridged, indented, roughened, or otherwise non-flat appearance, which can impart or mold the same features into the surface of the void. FIGS. 1 and 2 illustrate non-limiting embodiments of displacement pieces with 200 surface features 225.

When the UHPC has cured, the displacement piece 200 can be removed to form the one or more voids 120 in the shell 100. Thus, in one embodiment, at least a portion of the displacement piece is left uncovered by the UHPC, so that the displacement piece will be accessible for removal after the UHPC cures. In one embodiment, the displacement piece is sacrificial such that it can be destroyed, broken, or otherwise, rendered unusable again after being removed from the void. For example, the displacement piece can be made of materials such as foam, wood, textile, plastic, aluminum, or other easily deformable metal or alloy, combinations thereof that can be removed intact or broken, chipped, cut or variously disassembled in a piecewise fashion from the cured shell. FIGS. 2, 11A and 11B illustrate examples of a foam displacement piece that, if necessary, can be removed in pieces. In another embodiment, the displacement piece 200 is a reusable structure, such that it can be removed intact or in sections that can be reused to form a void in another shell formwork. By way of example, the displacement piece can be a rigid form that can be forcibly removed from the cured shell. Alternatively, a displacement piece can be a collapsible structure that can hold a desired shape during use, but can be collapsible, disassembled, or reduced in size after the UHPC has cured. As another example, the displacement piece can be two or more connectable components, such as, for example, plates or sections that can be connected during use and then disconnected for removal from the cured UHPC void 310.

Figure 3:
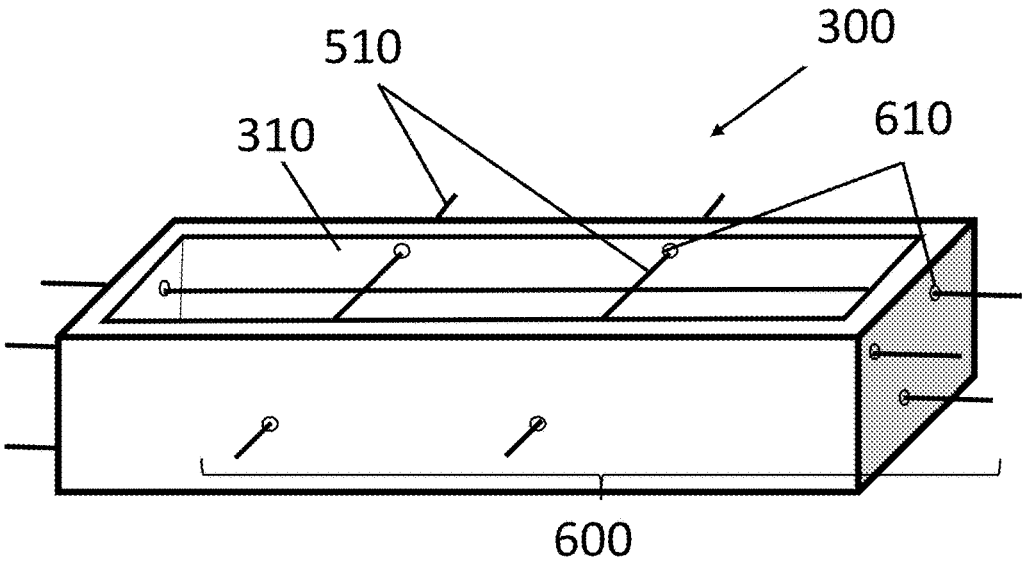
FIG. 3 is an illustration of an Ultra-High Performance Concrete (UHPC) Shell. Also shown is a reinforcement cage arranged in the UHPC shell.
Figure 4:
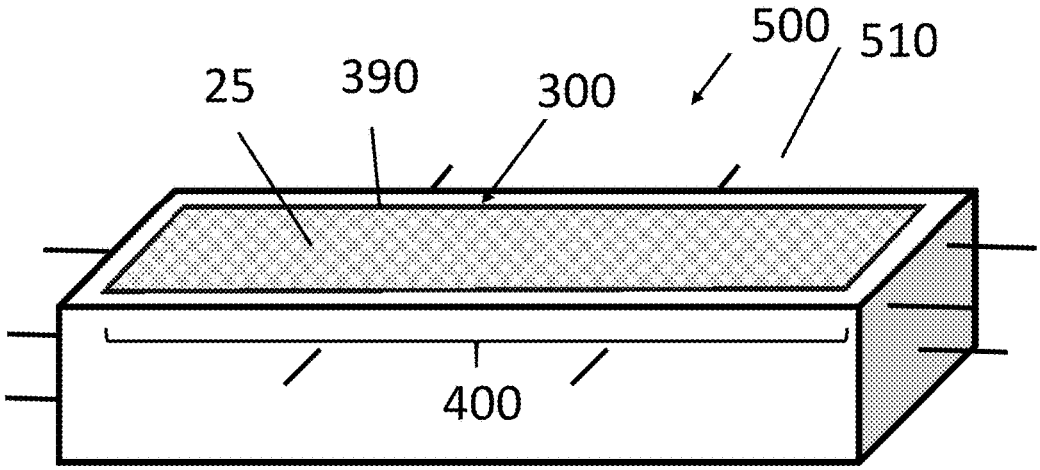
FIG. 4 is an illustration of a completed composite construct with the extended rods of a reinforcement cage embedded therein.
Figure 6:
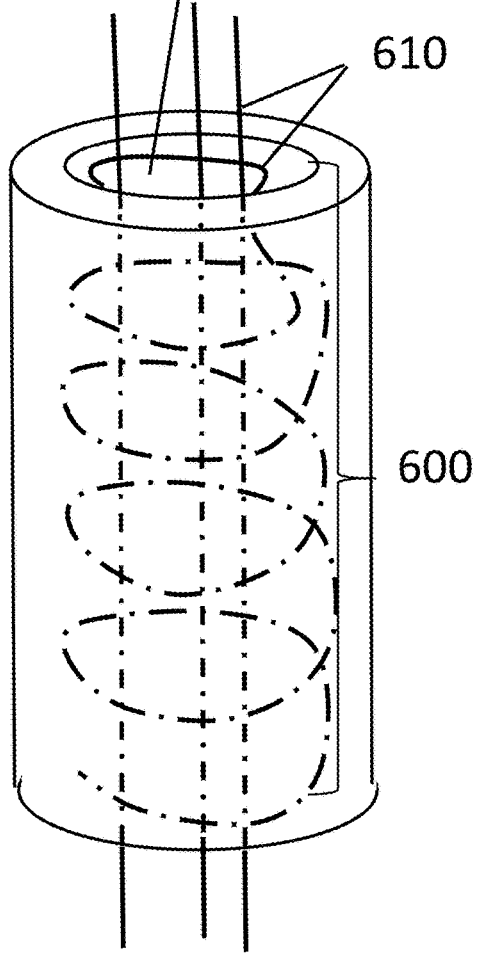
FIG. 6 is an illustration of a columnar-shaped UHPC shell with a spiraled reinforcement cage and reinforcement rods positioned within the void prior to placement of UHPC.

Concrete structures are often reinforced with metal rods 610, such as, for example, mild steel bars. The concrete composite constructs 500 of the subject invention can also be reinforced with one or more metal rods, such as mild steel bars. In one embodiment, a reinforcement cage 600 of mild steel bars is arranged in the void 310 prior to the NSC being placed therein. FIG. 3 illustrates a non-limiting example of a reinforcement cage 600 of reinforcement rods 610 arranged and secured in position within a void. FIG. 6 illustrates an embodiment of mild steel bars that are bent or curved to form a spiral shape.

Figure 7A:
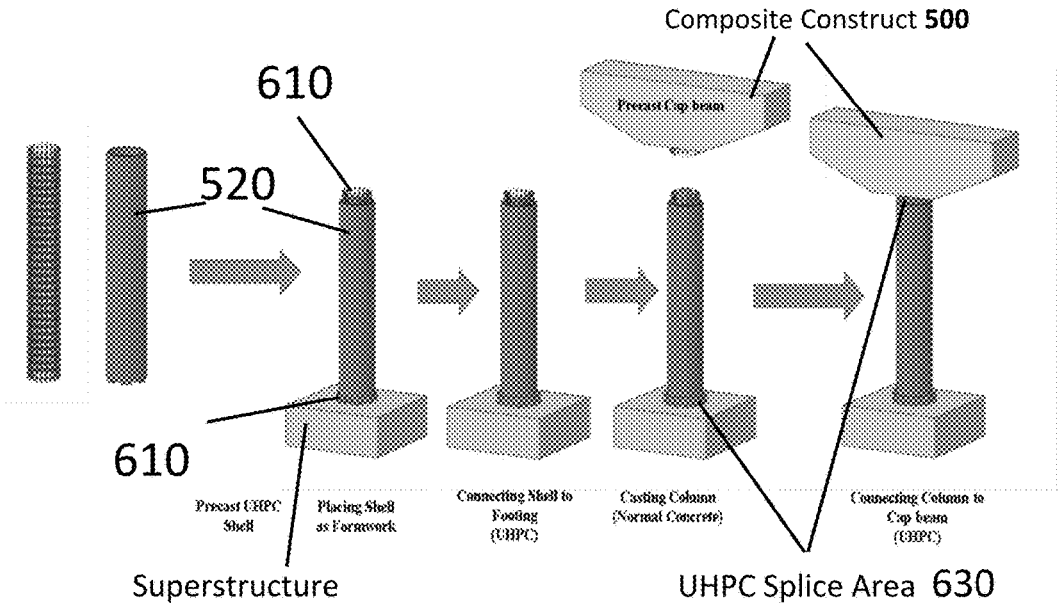
FIG. 7A is an illustration of composite constructs arranged to be joined together. As seen here, the overlapping extending rods of the reinforcement cages form a slice area. The splice area can be filled with UHPC, NSC, other materials or combinations thereof.
Figure 7B:
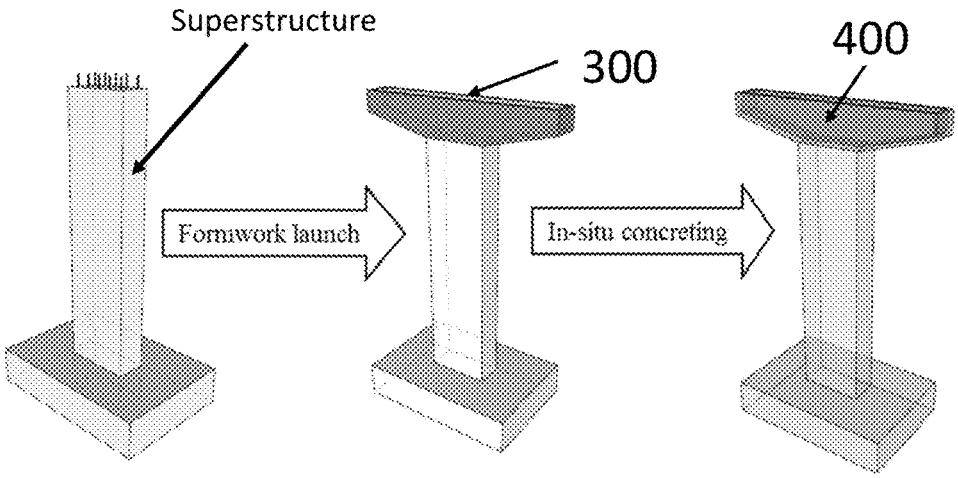
FIG. 7B illustrates a method by which a composite construct can be formed in situ on a superstructure.

In a further embodiment, the UHPC shell is configured with ports 610 through which the reinforcement rods 600 extend, as shown, for example, in FIG. 3. When concrete structures are joined, the reinforcement rods 610 extending from two or more constructs or from the superstructure are overlapped to form a splice area 630, an example of which is shown in FIG. 7A. The splice area can be filled with UHPC, NSC, or some combination thereof. It is also possible for composite constructs to be formed in situ. FIG. 7B illustrates a method by which a UHPC shell 300 can be positioned on a superstructure and subsequently filled with NSC. In one embodiment, a UHPC shell formwork, in the shape of cap beam can be prefabricated and transported to a site. While on site it can be placed on top of column and filled with NSC, after placing a steel cage. It should be noted that the column and foundation elements shown in FIG. 7B could also be constructed using UHPC shell formwork methods.

Following are non-limiting examples that illustrate procedures for practicing the subject invention. These examples are provided for the purpose of illustration only and should not be construed as limiting. Thus, any and all variations that become evident as a result of the teachings herein or from the following examples are contemplated to be within the scope of the present invention.

I. Composite Construct Beam

Construction of a composite construct beam 510 begins with a shell formwork 100, such as shown in FIG. 1 to form a UHPC shell 300 for the beam. The shell formwork will form the outside shape of the UHPC shell. A displacement piece 200 can be arranged in the formwork to create a void 310. FIG. 2 illustrates a single displacement piece that can be arranged in the formwork, but a multiple-section displacement piece could also be used. The displacement piece should be secured in place in the formwork to inhibit movement. The displacement piece shown in FIG. 2 is foam, which would tend to float. To secure it in place, one or more positioning apparatuses 120 can be placed on, over, or within the formwork and against, and, in some situations, attached to the foam displacement piece to hold it in position within the formwork.

Ultra High Performance Concrete (UHPC) can be deposited in the shell formwork and around the displacement piece. The UHPC will cure in the shell formwork and around the displacement piece. Once cured, the shell formwork and displacement piece can be removed from around the resulting UHPC shell 515, shown, for example, in FIG. 3 for forming the composite construct beam 510.

The UHPC shell is considerably lighter than a full-cast concrete beam, which makes it easier and more efficient to transport to an on-site location. On-site, the UHPC shell can be filled with a NSC, which cures in and fuses to the UHPC shell. Reinforcement structures, such as metal bars, can be placed in or through the shell formwork in advance of depositing the NSC. Ideally, the thickness of the UHPC shell will support the weight of the standard or normal strength concrete (NSC), for example, concrete made with Portland cement, without cracking or breaking. A person of skill in the art will be able to determine the dimensions of a shell formwork and displacement piece that will provide sufficient thickness to the shell to support the NSC.

Once the NSC cures, the resulting composite construct beam 510 can be manipulated and placed as any other beam would be. The UHPC shell is more durable than the NSC core and is moisture resistant. Thus, the UHPC shell can protect the inner NSC core and provide a longer lasting structure.

II. Composite Construct Column

Casting of a composite construct column 520 can proceed similarly to that of the composite construct beam, described above. Where the column shell formwork will impart a circular circumference, such as that shown in FIGS. 5, 6, and 7, the formwork can be taller than it is wide. A columnar-shaped displacement piece 200, as shown in FIG. 5 can be inserted into the formwork. UHPC next deposited in the formwork will settle and cure within the formwork and around the columnar-shaped displacement piece. When the columnar displacement piece and shell are removed, there is a tubular UHPC shell with a hollow columnar shape in which NSC can be deposited to form the composite construct column 520.

Reinforcement structures can also be employed with a columnar concrete construct. FIG. 6 illustrates a unique configuration for reinforcement structures that are coiled or twisted inside the void 310 before depositing NSC therein.

III. Composite Construct Arch Units

Figure 10A:
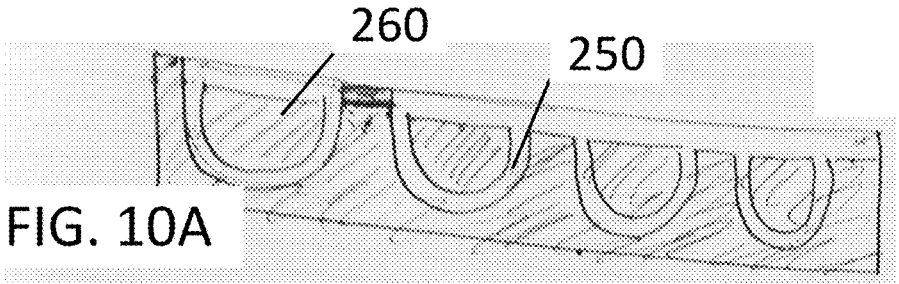
FIGS. 10A-10E illustrate different stages in the manufacture, joining, and filling of a UHPC arch unit.
Figure 10B:
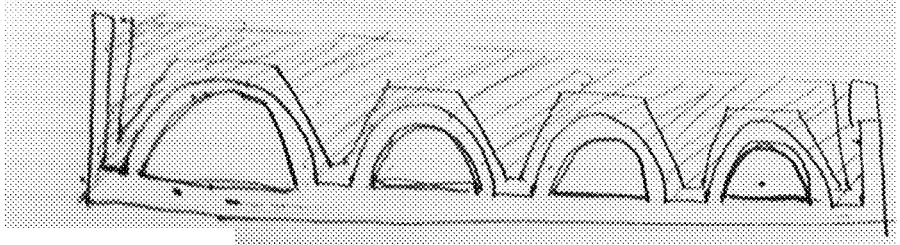
Figure 10C:
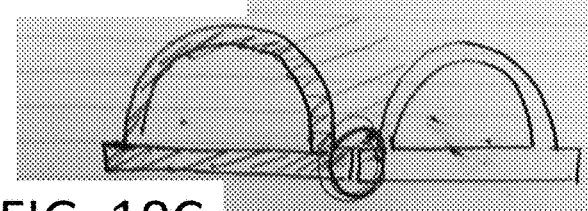

Construction of a composite construct arch unit 530, of the type typically used in short span bridge construction, begins with a shell formwork 100, such as shown in FIGS. 11C, 11D, and 11E in which a UHPC shell for an arch unit can be formed. As used herein, an arch unit can include one or more semi-circular arch shapes. Initially, one or more bow-shaped displacement pieces 250 can be arranged in the formwork 100 which have vaults 252, or channels directed at the top side 4, shown, for example, in FIG. 10A. A bow-shaped displacement piece can be a single piece arranged in the formwork. Multiple-section bow-shaped displacement pieces could also be used. Furthermore, a formwork can contain one or more bow-shaped displacement pieces to form smaller or larger arch units. The bow-shaped displacement piece should be secured in place in the formwork to inhibit movement. The bow-shaped displacement piece shown for example in FIGS. 11A-11E is foam, which would tend to float on the UHPC. To secure it in place, one or more positioning apparatuses 120 can be placed on, over, or in the formwork and against, and, in some situations, attached to the foam bow-shaped displacement piece to hold it in the formwork.

To create the UHPC shell for an arch unit 530, a second semi-circular displacement piece 260 can be placed in the vault 252 of each of the one or more bow-shaped displacement pieces, with the curved side within the vault, such as shown in FIGS. 11A and 11C. The semi-circular displacement piece can be positioned so that there is a space 270 between it and the bow-shaped displacement piece, an example of which is shown in FIGS. 11C and 11E. The semi-circular displacement piece can be secured in place to maintain the appropriate position and space.

Figure 10D:
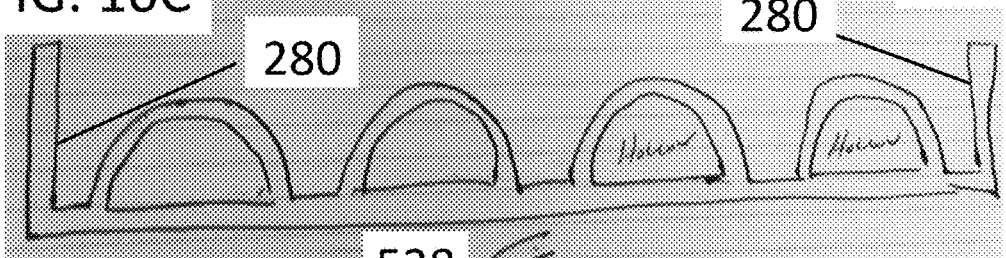
Figure 10E:
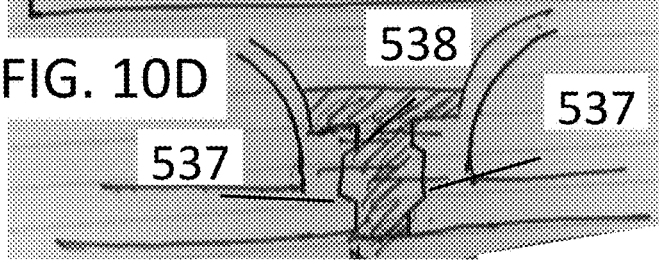

In one embodiment, an arch unit is formed with a lip 535 one or both outer edges 536. When UHPC shells for arch units are placed next to each other, the lips can make contact, such as shown, for example in FIGS. 9A and 10D. In one embodiment, the shells for arch units are placed next to each other, but are not connected prior to NSC being deposited over the arranged side-by-side arch unit shells. In an alternative embodiment, the shells for arch unit shells are joined prior to the NSC being deposited over the arranged side-by-side arch unit shells. FIG. 10E illustrates one embodiment of a lip having a profile 537 that forms a plug 538 when a grout, concrete, or other connective material is disposed between two lips. Preferably, the profile has indentations or grooves that inhibit the plug from being pushed or pulled out of the profiles. FIG. 10E shows an example of a plug formed between two lip profiles which have a widening between the lips that can inhibit the plug from being extracted from between lips in either a top 4 or bottom 2 direction.

One embodiment of an arch unit can be formed with a containment wall. For example, a specific shell formwork can be built so that an arch unit is formed with a containment wall 280 on one side. A containment wall can help to form the void 310 that will eventually contain the NSC. FIGS. 9A and 10D illustrate arch units with containment walls, which are placed at either end of a plurality of arch unit UHPC shells. When multiple arch units are positioned next to each other the arch units with containment walls at each end can contain the NSC.

Ultra High Performance Concrete (UHPC) can be deposited in the formwork and around the bow-shaped and semi-circular displacement pieces. The UHPC will cure in the formwork, in the space 270, and around the displacement pieces. Once cured, the formwork and displacement pieces can be removed from around the resulting arch unit UHPC shell 300. Multiple arch unit shells can be placed side by side, as shown, for example, in FIG. 9B.

The UHPC shell for forming the composite construct arch is considerably lighter than a full-cast arch element, which makes it easier and more efficient to transport to an on-site location. On-site, the arch shell can be filled with a NSC, which cures in and fuses to the UHPC shell. Reinforcement structures, such as metal bars, can be placed in or through the shell formwork in advance of depositing the NSC. Ideally, the thickness of the UHPC shell will support the weight of the standard or normal strength concrete (NSC), for example, concrete made with Portland cement, without cracking or breaking. A person of skill in the art will be able to determine the dimensions of a shell formwork and displacement piece that will provide sufficient thickness to the shell to support the NSC.

Once the NSC cures, the resulting composite construct arch, having one or more arches, can be manipulated and placed as any other arch would be. The UHPC shell is more durable than the NSC core and is moisture resistant. Thus, the UHPC shell can protect the inner NSC core and provide a longer lasting structure.

Example: Analysis of Performance Characteristics of Ultra-High Performance Concrete (UHPC) and Normal Strength Concrete (NSC) Composite Construct To investigate the merits and feasibility of a composite construct using a UHPC shell as formwork, one specific application was studied. Specifically, a study was conducted on the feasibility of using a UHPC shell as formwork for a cap beam for use in modular Advanced Bridge Construction (ABC) projects.

The study had three primary objectives:

1) understand the behavior of a UHPC formwork for a beam element 2) understand the composite action between a UHPC formwork and NSC 3) obtain data pertaining to the long term shrinkage behavior of post-poured NSC In this study, a three-point loading test was carried out on a composite construct manufactured according to the subject invention and a control beam. Comparative results are presented in terms of failure mode, load deflection and stress-strain.

Concept Development:

According to the American Association of State Highway and Transportation Officials (AASHTO) (2012), stay in place formwork is to be designed to remain elastic under construction load. Prior to conducting this study, a finite element analysis was performed using Advanced Tool for Engineering Nonlinear Analysis (ATENA) software. The aim of the analysis was to analyze stresses and deflections due to construction loads. The analysis was performed on a 2-inch thick shell for two load cases. The first load case considered stresses due to self-weight of the formwork. The second case load case considered gravity load and lateral pressure created by normal strength concrete used to fill the UHPC shell. The material properties in the model were taken from earlier published work (M. Shafieifar, M. Farzad, and A. Azizinamini, "Experimental and numerical study on mechanical properties of Ultra High Performance Concrete (UHPC)," *Constr. Build. Mater.*, vol. 156, pp. 402-411, December 2017) that used a similar UHPC composition. The tensile capacity of the UHPC was taken as 1.2 ksi and compressive strength as 22 ksi. The shell formwork was numerically modeled using fracture plastic constitutive model in ATENA with 3-D brick element having 20 nodes. The bottom horizontal face of the prismatic beam was assumed fixed.

Figure 12:
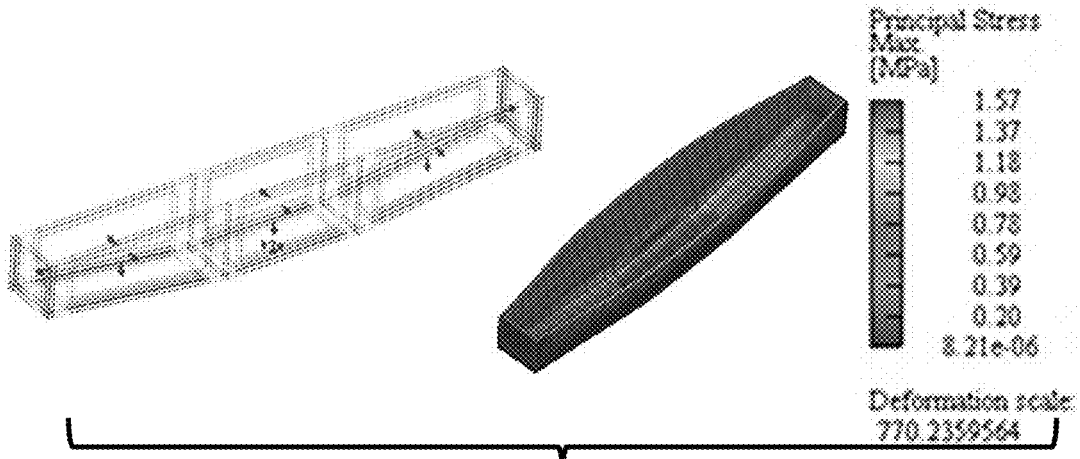
FIG. 12 illustrates a finite element analysis of an embodiment of a UHPC shell formwork.

The results are shown in FIG. 12 and indicate that the critical location of stresses occurred at the joint between UHPC formwork base and wall. The maximum principal stress for self-weight and wet concrete was 47 psi and 227 psi, respectively. The maximum deformation predicted was 0.01-in., which occurred due to lateral pressure on the UHPC formwork walls. The dimensions of the UHPC shell formwork and the other dimensions are shown in FIG. 13.

The stresses in UHPC shell formwork were significantly lower than the tensile capacity of the UHPC. Safdar et al. (M. Safdar, T. Matsumoto, and K. Kakuma, "Flexural behavior of reinforced concrete beams repaired with ultra-high performance fiber reinforced concrete (UHPFRC)," *Compos. Struct.*, vol. 157, pp. 448-460, December 2016) used 0.75-in and 1.5-in thick UHPC for protection of retrofitted beams while 2.3-in for strengthening. The intent of formwork is to provide both strength and durability, therefore a 2-in thickness of unreinforced UHPC was chosen for both walls and base of formwork.

Figure 13:
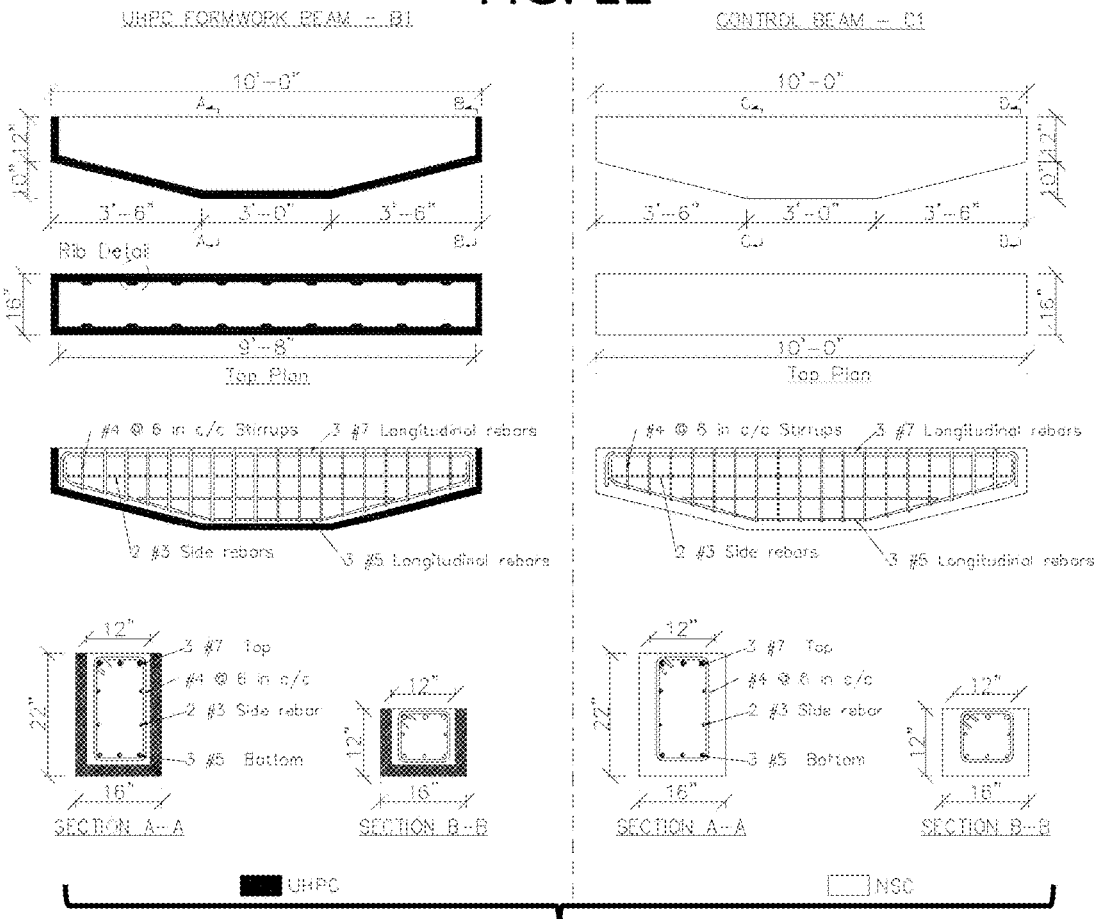
FIG. 13 shows dimensions and reinforcement details for test beams B1 and C1.

Experimental Program and Testing:

To validate the concept, a composite beam (B1) was constructed with a UHPC shell formwork in a shape as shown in FIGS. 12 and 13. To provide a base line for comparison a control beam (C1) with similar dimensions was constructed using NSC. The shrinkage and creep were monitored for beam B1. Material testing was carried out for UHPC and NSC for compression. A three-point bending test was carried out on both beams. Cap beams are used in bridge to transfer load from bridge girders to bent column. The cap beam can be evaluated either as a conventional beam or "deep beam" based on the shear span to depth ratio (a/d). Typically, a beam with a/d of less than 2.5 is considered to be deep beam and specifications recommend the use of a strut and tie model for analysis. In this study, using a three-point loading test, the a/d ratio of the non-prismatic cap beam is 2.6, so the cap beam is designed as a conventional non-prismatic beam.

Specimen Description

An experimental program consisted of testing UHPC shell beam (B1) and a control specimen (C1). The beams were designed for flexure failure. Both beams are dimensionally similar with a length of 10-ft and an effective span of 8.5-ft. The cross-section of the beam was 16-in by 22-in at the center and 16-in by 12-in at the tapered ends. Typical cap beams have tension reinforcement located at the top while compression reinforcement at the bottom. The reinforcement consisted of three #7 bars at top and three #5 bars at bottom. The stirrups, consisting of #4 bars, were placed at every 6-in along the length of beams. The reinforcement ratio of specimen for compression and tension were almost 0.3% and 0.58% at the center. Additional skin reinforcement is provided along the depth of the beam. The dimensions and reinforcement details are provided in FIG. 13.

Figure 14:
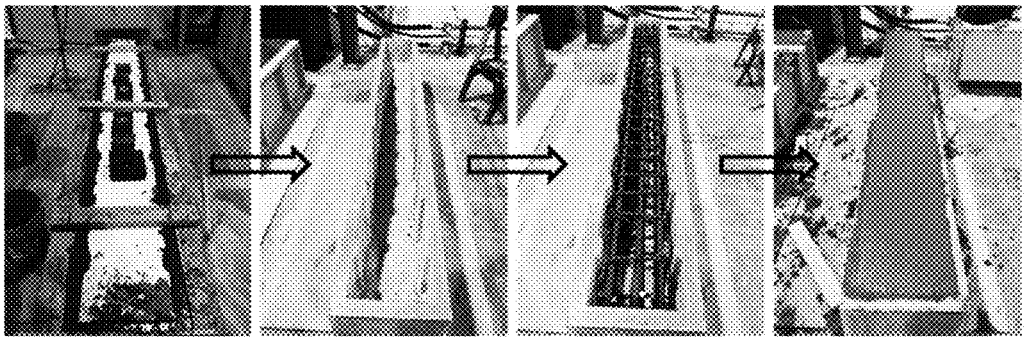
FIG. 14 demonstrates the construction sequence for a beam B1.

Construction of Specimen and Material Properties:

For beam B1, the UHPC shell formwork was constructed using a closed-cell foam (e.g., Styrofoam®) mold. Studies have shown that the best orientation and dispersion of fibers occurs when flow of UHPC is in the flexural tension direction. Accordingly, the UHPC was poured from the ends of the beam parallel to the longitudinal direction. The UHPC shell formwork was cast monolithically to avoid any connection and the closed-cell foam mold was removed. The UHPC form was covered with plastic sheet and cured for 7 days under normal room temperature (75±3° F.). No reinforcement was provided in the shell formwork. The sequence of construction for the UHPC beam is shown in FIG. 14.

The bond between UHPC and NSC at interface is important for composite behavior. Previous studies have investigated different interface roughness for UHPC deck overlays to achieve a composite behavior. (("Use of Ultra-High-Performance Concrete for Bridge Deck Overlays TR-683 March 2018," 2018) Alternatively, bonding agents and adhesives have been used to facilitate the bond between UHPC and concrete surfaces (P. R. Prem, A. Ramachandra Murthy, G. Ramesh, B. H. Bharatkumar, and N. R. Iyer, "Flexural Behaviour of Damaged RC Beams Strengthened with Ultra High Performance Concrete," in *Advances in Structural Engineering*, New Delhi: Springer India, 2015, pp. 2057-2069 and M. A. Al-Osta, M. N. Isa, M. H. Baluch, and M. K. Rahman, "Flexural behavior of reinforced concrete beams strengthened with ultra-high performance fiber reinforced concrete," *Constr. Build. Mater.*, vol. 134, pp. 279-296, March 2017). The use of interface roughness and bonding adhesives are more useful when used on an existing layer of concrete such as grooved deck overlays or roughened concrete beams.

In this study, to achieve a composite action, equally spaced vertical ribs were provided inside the UHPC shell form along the depth. The ribs were 3-inches wide, 0.75-inches thick and spaced 9-inches along the length of the beam. The inner face of the formwork was not roughened and no mechanical connectors or bonding agents were used. Based on the geometry of the shell form, the clear cover for side walls was 2.75-inches and 2-inches for the bottom wall. During in situ casting of beam B1, temporary props were used at tapered ends as temporary support.

For control specimen C1, a conventional plywood formwork was used for construction. The reinforcement cages of both beam B1 and C1 were placed in the UHPC shell and plywood formwork. The cover for the control specimen C1 was kept similar to the beam B1. The NSC of the control specimen C1 and the UHPC shell beam were cast together. AASHTO (2012) specifies that the age of stay in place formwork at the time of placement of in situ concrete should be such that the differential creep and shrinkage are minimized. This is recommended to reduce interface shear stresses. For this reason, at the time of casting of NSC for both beams, the UHPC shell form had achieved an age of 64 days. To prevent drying shrinkage, the troweled surfaces of beams were covered with plastic sheeting. FIG. 14 shows the sequence of construction of beam B1.

For this study, Ductal® UHPC was used, which is made from a premix powder, water, superplasticizer and straight steel fibers (2% in volume). Concrete samples of 3-in×6-in and 4-in×8-in cylinders were made and tested for both UHPC and NSC, respectively. The average compressive strength of UHPC at the time of testing was 24.4 ksi which is more than the assumed value for numerical analysis. The average compressive strength for NSC was 6.4 ksi. The reinforcing steel used was a Grade 60 ASTM A706 bars in three sizes of #4, #5 and #7, with nominal yield stress of 68 ksi.

Shrinkage Monitoring

Shrinkage in concrete can cause cracking, which can lead to durability issues. In the case of UHPC shell formwork, the curing of NSC occurs inside the formwork and the performance of the interface between these two materials can pose a concern due to shrinkage of NSC. In this case, the drying occurs from the top face of the shell beam, where the NSC is exposed. The ribs in the shell formwork and the hardened UHPC restrains free shrinkage of the NSC, but causes additional stresses which must be taken into consideration.

Figure 15A:
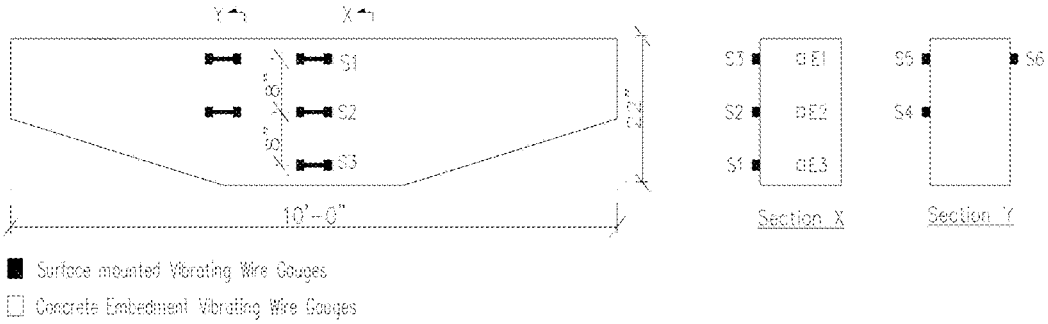
FIG. 15A shows the instrument details for the stress test on beam B1.
Figure 15B:
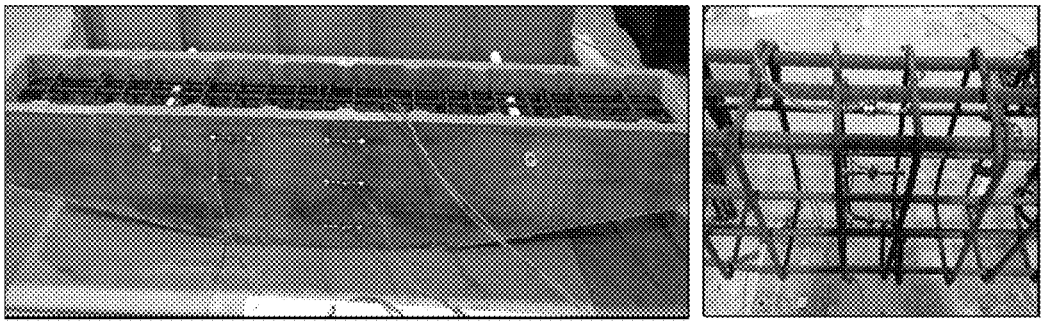
FIG. 15B shows the installation of the VWGs used for the stress test of beam B1.

The age of the UHPC shell formwork was 64 days at the time of in situ concreting. This difference in time of casting between two dissimilar materials may induce stresses due to differential shrinkage. To assess the differential shrinkage, strains were monitored externally on shell form and internally on in situ NSC. The strain measurements were made using vibrating wire strain gages. This monitoring was performed only on beam B1 after casting of NC. No monitoring was performed on the shell formwork prior to in situ casting. This is due to the fact that UHPC is attributed with low creep and shrinkage and any changes before in situ casting are unlikely to affect interface behavior. Therefore, prior to casting of NSC in the prefabricated shell, vibrating wire gauges (VWG) were installed. The shrinkage of the UHPC shell formwork was monitored with surface mounted VWG (Geokon Series 4000), which has a gage length, resolution, and measurement range of 150 mm, 1.0 με and 3000 με, respectively. The shrinkage of in situ NSC was monitored with embedded VWG (Geokon series 4200), which has a gage length, resolution and measurement range of 155 mm, 1.0 με and 3000 με, respectively. The embedded VWGs were mounted on rebar. For both surface and embedded VWGs the monitoring was performed starting one day after casting and continued for 56 days. Both types of VWG strain gauges were placed along the length of the specimen at various locations and depths, as shown in FIGS. 15A and 15B. Shrinkage measurements were not performed for control beam.

Test Setup

Figure 16A:
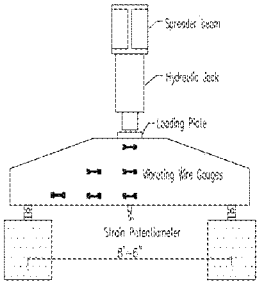
FIGS. 16A and 16B illustrate the test setup details (16A) and procedure (16B) for the stress test of beam B1.
Figure 16B:
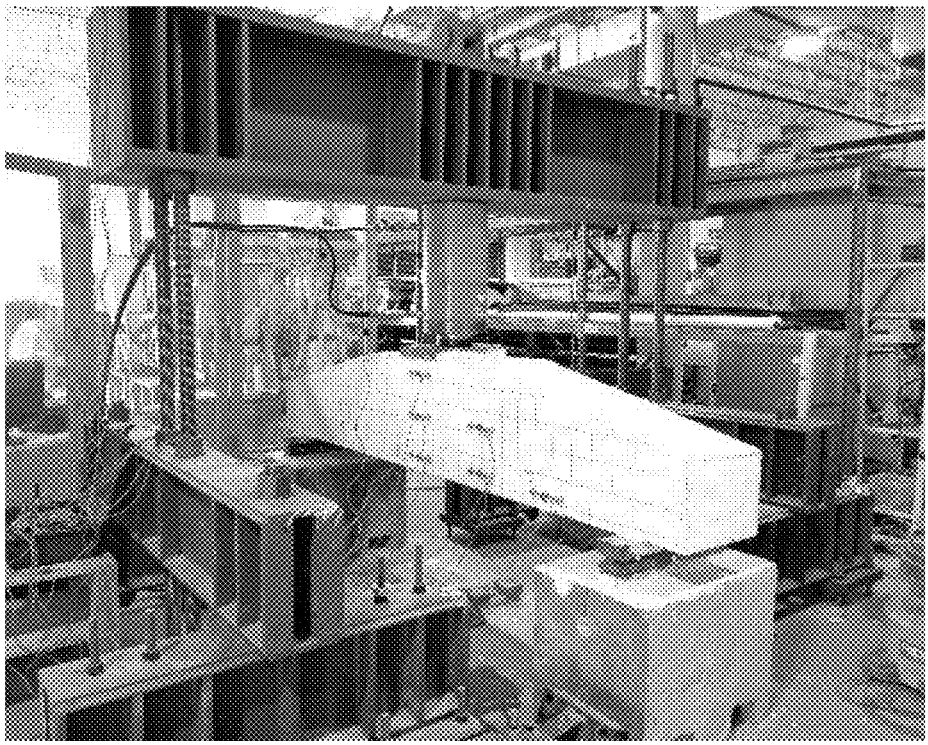

The testing on beam specimens was carried out in the Structural Laboratory at Florida International University (FIU). The three-point loading test was carried out after completion of shrinkage monitoring of shell beam. In order to replicate the structural behavior and have a simplified test setup, the beam specimens were tested in an inverted position. The specimens were placed over roller supports giving an effective span of 8.5 ft., as shown in FIG. 16A. The hydraulic ram was attached to a spreader beam which was anchored to the strong floor through threaded bars, as shown in FIG. 16B. A displacement-control load was applied through the hydraulic ram with a maximum stroke of 13-in. The loading was monitored with both load cells and pressure transducers. The deflection was monitored and recorded using linear displacement transducers.

Figure 17A:
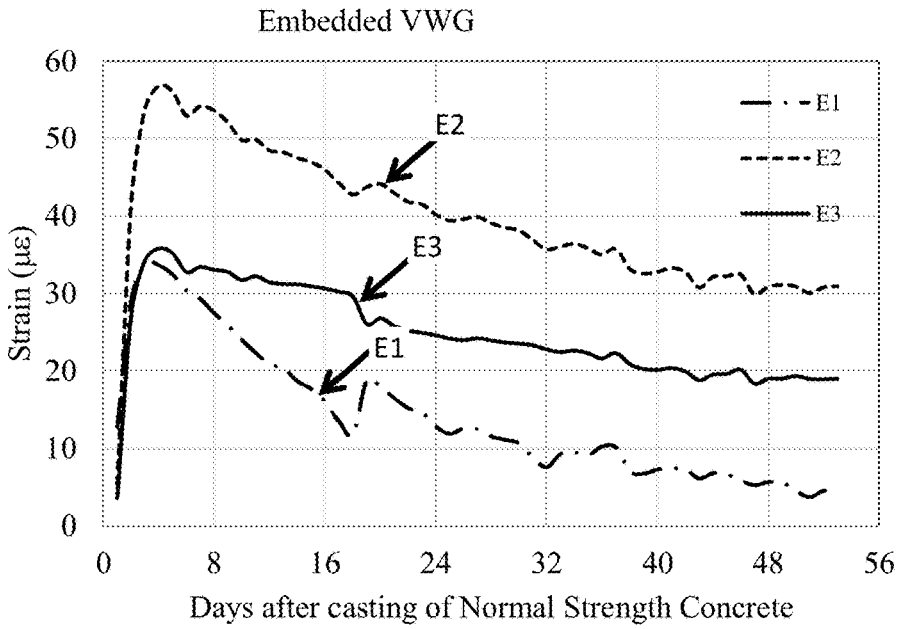
FIGS. 17A and 17B show the shrinkage behavior of embedded VWG (top) and surface VWG (bottom) for beam B1.
Figure 17B:
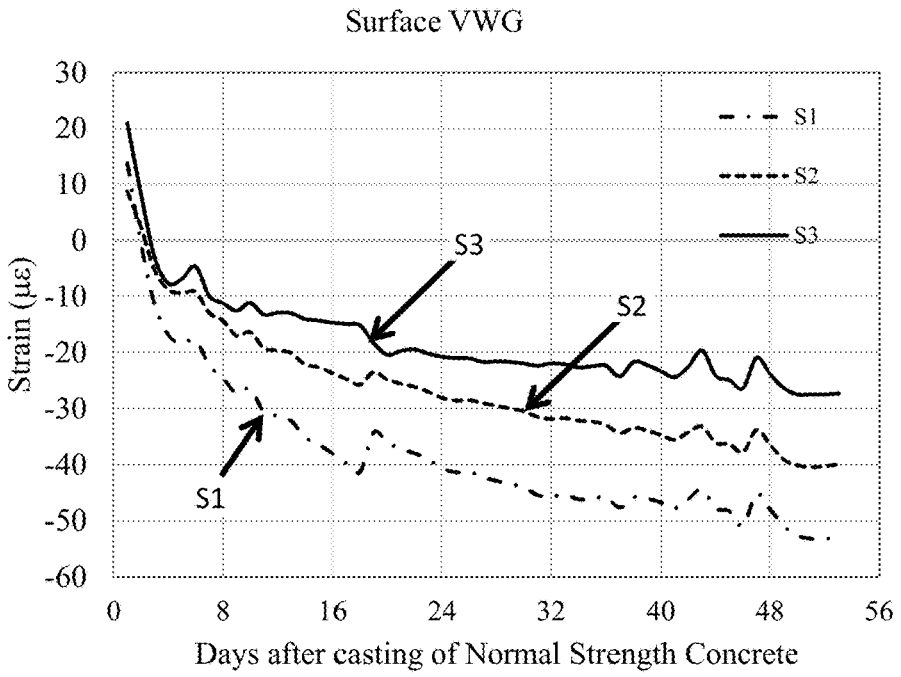

Shrinkage Monitoring Results:

The shrinkage monitoring of beam B1 was started 1 day after pouring of NSC and continued over a period of 56 days. Concrete embedded VWGs measured the volume and temperature strains. The shrinkage results are plotted in FIGS. 17A and 17B for embedded and surface gauges, respectively, which were located at mid-section of beam, as shown in FIGS. 15A and 15B. In FIG. 17, positive strains signify tension in the concrete and negative strains indicates compression.

After pouring, the NSC undergoes short term thermal expansion due to exothermic reactions and then starts shrinking over a period of time. The results show that the NSC reached the peak strains after almost 12 hours of pouring. The shrinkage results are affected by the depth of gauge from the exposed surface. The VWGs on UHPC shell formwork show an initial increase in compressive strains, which stabilizes over time. This compression in the UHPC formwork is induced by shrinkage of NSC through composite action. The sudden change in slope at 18-days is attributed to removal of temporary props placed at the tapered end of the NSC beam.

Figure 18A:
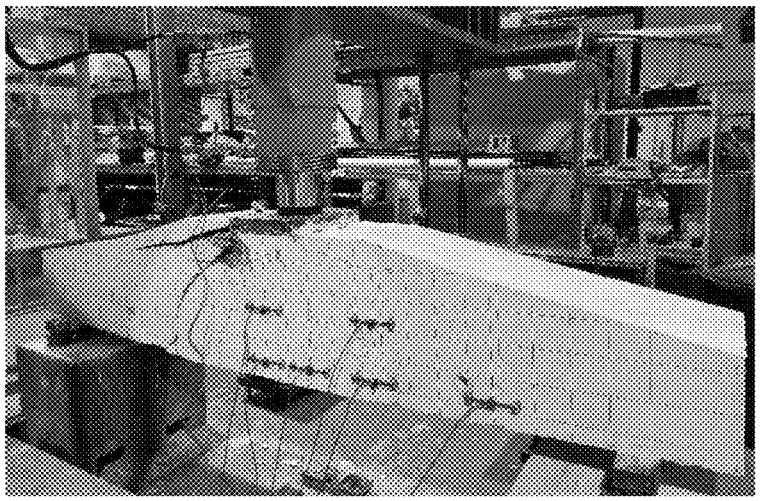
FIGS. 18A and 18B demonstrate the crack pattern in beam B1 (top) and beam C1 (bottom) at the end of loading.
Figure 18A:
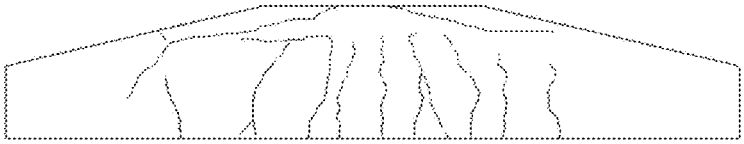
Figure 18B:
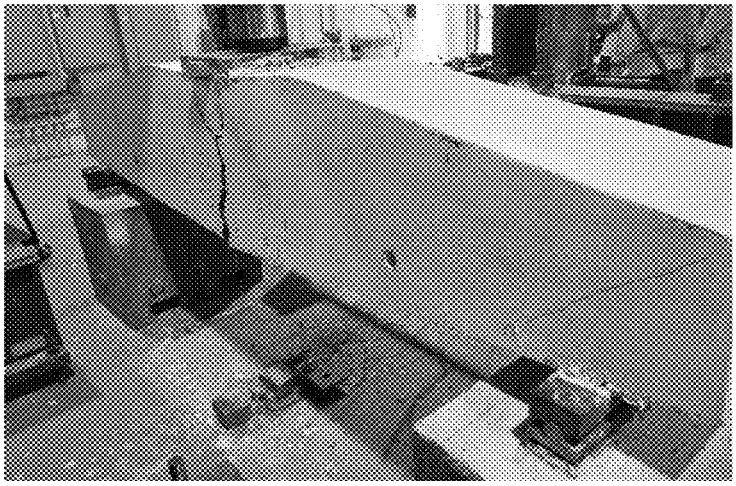
Figure 18B:
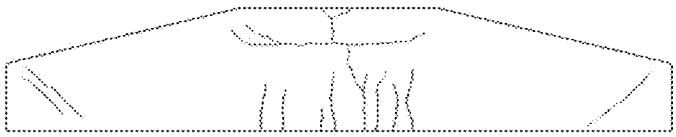

Load Test Results:

The beams were tested in an inverted position and the test was carried out in a three-point loading setup. The load was applied in the center of the beams using a 16-in×16-in×2-in steel plate. A grid was marked on the face of the beams to identify and record crack patterns. FIG. 18A shows the crack patterns at the end of loading. The variation in crack patterns of beam B1, in FIG. 18A, and beam C1, in FIG. 18B, can be attributed to material properties and interface behavior of UHPC shell formwork.

The control beam C1 was loaded and the first cracks appeared at about 15 kips. The loading was continued until a peak load of 138 kips was reached. Extensive cracking was observed at this stage. After yielding of reinforcement, there was no increase in load carrying capacity. The failure of a beam occurred when concrete crushing at the top diagonal shear cracks were observed, at which time testing was halted.

The UHPC formwork beam B1 developed initial cracks at 30 kips, which appeared in the NSC and no cracks were observed in the UHPC shell at this stage. With increased loading, the cracks in NSC spread along the length of B1 beam. A few cracks in UHPC shell were observed after 80 kips, which were concentrated mostly in the middle of the beam. The peak load was reached at 160 kips. With increased loading, a localized vertical crack formed in the UHPC shell formwork wall. This discrete crack was located on both side walls. The crack in the UHPC shell formwork caused a drop in the load capacity of the beam B1. This drop was recovered as the loading continued by strain hardening in the steel reinforcement. The UHPC shell formwork, when under compression, prevented the top of the beam from crushing and consequently the specimen experienced high ductility. The excessive ductility and deflection of the beam caused the roller support to dislodge from one end of the beam. At the end of loading, the dominant crack in the UHPC shell formwork was due to crack localization and fiber pull out in the UHPC shell in the vicinity of the vertical crack in middle of the beam. The testing was halted at this point.

Figure 19:
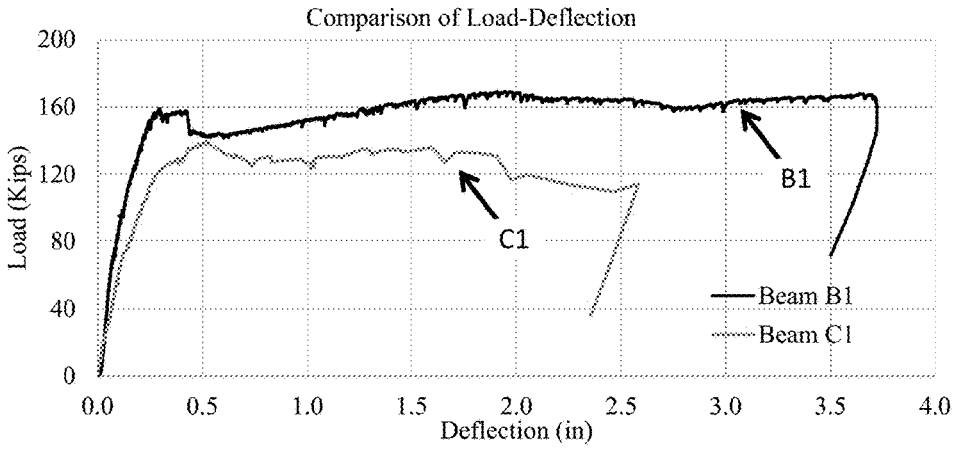
FIG. 19 is a graph of the load deflection curve for beam B1 and beam C1.

The load deflection response of both the B1 and C1 test specimens are shown in FIG. 19. As indicated in FIG. 19, the stiffness of the UHPC shell formwork beam B1 was higher than the control beam C1. The comparison of the load deflection curves shows an increase in capacity of 14% for a UHPC shell formwork beam. After peak load, it can be seen in FIG. 19 that there was an abrupt drop in load for beam B1. At this point, the UHPC shell formwork had a few discrete cracks in the middle. After the drop, the beam B1 exhibited sustained post-cracking tensile capacity and ductility.

Figure 20A:
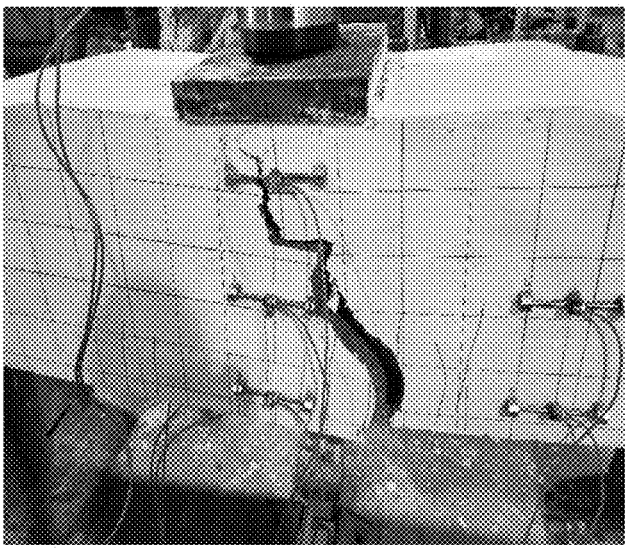
FIGS. 20A and 20B show the failure mode of beam B1 from the side (left) and from the bottom (right).
Figure 20B:
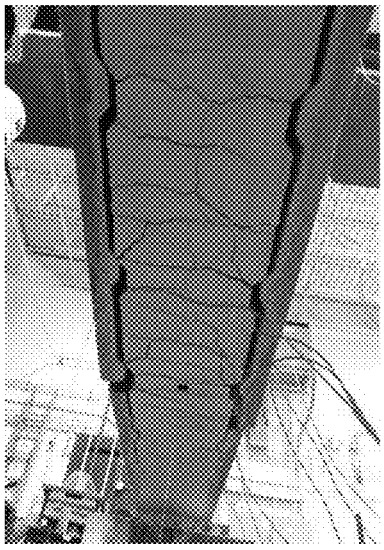
Figure 21A:
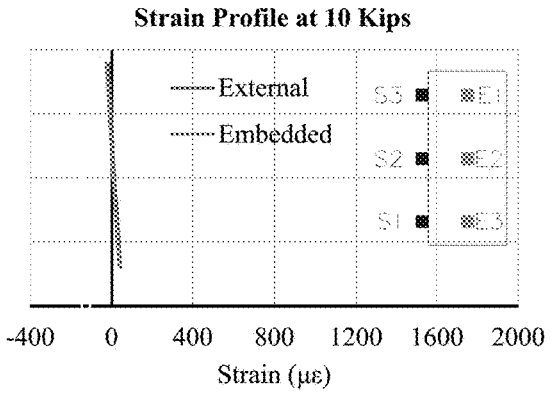
FIGS. 21A, 21B, 21C, and 21D show the strain profiles of beam B1 against different load levels.
Figure 21B:
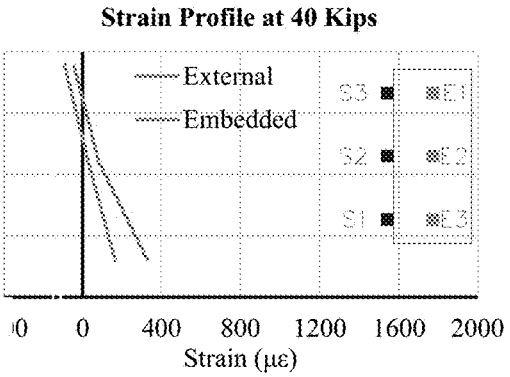
Figure 21C:
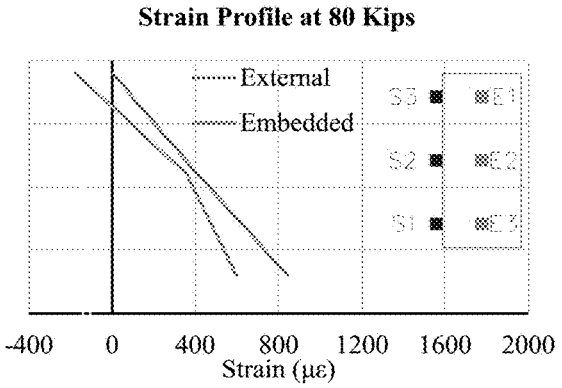
Figure 21D:
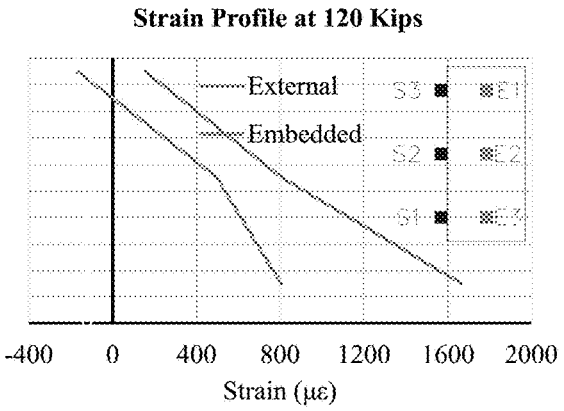

At the initial stage, the ribs provided a composite action between the shell and NSC. The composite action was reduced as the loading increased. This is primarily because UHPC does not contain large aggregates to provide interlock at the interface plane. After debonding between the interface, the NSC separated from the UHPC shell and extensive cracking was observed in NSC inside the shell, as shown in FIG. 20.

The surface VWGs were used to monitor mechanical strains of beam B1. The arrangement of surface VWGs are used in the same configuration as shown in FIG. 15. The comparison of strain profiles of surface and embedded VWGs gauges are shown in FIG. 19. As anticipated, the beams experienced compression at the top and tension at the bottom. The external strain gauge reaches tensile capacity at the top when the load is about 120 kips. As indicated by FIGS. 21A-D, the strains registered by strain gages attached to UHPC shell (S1, S2 and S3) and those placed inside the NSC portion of test specimen B1 shows similar strains at low loads (10 kips). At higher loads the difference in strain increases and is most pronounced when applied load is 120 kips. Debonding between the UHPC shell and NSC is the main reason for this behavior.

The results of the experimental study demonstrate the feasibility of using prefabricated UHPC shell formwork for beam elements. Compared to the NSC control beam made by conventional methods, the UHPC shell beam showed an increase in flexure capacity and ductility.

To summarize, a composite construct 500 of the subject invention can be manufactured on-site utilizing a UHPC shell 300 that can be cast off-site. A shell formwork 100 is built to cast the UHPC shell and a displacement piece 200 positioned within the shell formwork forms the void 300 formed in a shell formwork. UHPC is deposited in the shell formwork and around the displacement piece. After the UHPC has cured, the displacement piece and shell formwork are removed to leave the UHPC shell. A reinforcement cage 600 of mild steel bars can be positioned and secured within the void and NSC can be deposited placed in the void to surround and embed the reinforcement cage. When the NSC cures the final product is a composite construct 500 with a UHPC outer layer and an inner NSC core 400. A portion of the reinforcement cage, such as the ends of the mild steel rods, can extend from the composite construct and be used to join one composite construct to another composite construct or other concrete construct to join it to the overall superstructure.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

The examples and embodiments described herein are for illustrative purposes only and that various modifications or changes in light thereof will be suggested to persons skilled in the art and are to be included within the spirit and purview of this application.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

What is claimed is:

1. A composite construct comprising: an outer shell comprising a first type of concrete comprising a moisture-resistant Ultra High performance Concrete (UHPC) and having a void that defines an inner surface, said void formed by a removable replacement piece; and a concrete core formed within the void comprising a second-type of concrete that, while curing, forms an interface with the outer shell where the second type of concrete fuses with the inner surface of the shell.

2. The composite construct, according to claim 1, further comprising a metal rod or reinforcement cage embedded within the concrete core.

3. The composite construct, according to claim 2, wherein the second type of concrete comprises Normal Strength Concrete.

4. The composite construct, according to claim 3, wherein the metal rod or reinforcement cage comprises mild steel.

5. The concrete construct, according to claim 2, wherein a part of the metal rod or reinforcement cage extends through the outer shell to the outside of the composite construct.

6. The composite construct, according to claim 4, comprising at least two flat sides.

7. The composite construct, according to claim 4, comprising a column with a circular circumference.

8. The composite construct, according to claim 4, comprising at least one arch formed therein.

9. A method for manufacturing a composite construct comprising: obtaining a shell formwork for the composite construct; positioning at least one displacement piece within the shell formwork; depositing a first type of concrete, comprising a moisture resistant High Performance Concrete (UHPC) in the shell formwork to surround the displacement piece, leaving at least a portion of the displacement piece uncovered by the first type of concrete; allowing the first type of concrete to cure around the displacement piece; removing the displacement piece after the first type of concrete has cured to form a void that defines an inner surface within the first type of cured concrete; removing the shell formwork from the cured first type of concrete to provide an outer shell with the void therein; positioning a reinforcement structure within the void: placing a second type of concrete in the void of the outer shell; and allowing the second type of concrete to cure within the void, so as to form an interface with the outer shell where the second type of concrete fuses to the inner surface, thereby forming a core within the outer shell resulting in the composite construct.

10. The method according to claim 9, further comprising a vault within the at least one displacement piece wherein another at least one displacement piece can be positioned.

11. The method according to claim 10, wherein the composite construct formed has an arch shape.

12. The method according to claim 11, further comprising joining two or more outer shells prior to positioning the second type of concrete in the voids of the joined shells.

13. The method according to claim 12, wherein the shells comprise a lip having a profile that facilitates joining of the two or more shells.

14. The method according to claim 9, wherein the second type of concrete is Normal Strength Concrete.

15. The method according to claim 9, wherein the at least one displacement piece is a rigid foam material and the method further comprises securing the displacement piece in position within the shell formwork.

16. The method according to claim 9, wherein a portion of the metal rod or reinforcement cage extends through the shell and outside the composite construct.

17. The method according to claim 16, further comprising joining the composite construct to a superstructure.

18. A composite construct comprising: an outer shell comprising a first-type of concrete comprising a moisture-resistant Ultra High Performance Concrete (UHPC) and having a void formed by a foam displacement piece that defines an inner surface, such that, when the foam displacement piece is removed, the void is formed with the outer shell; a concrete core formed within the void comprising a second-type of concrete comprising normal strength concrete that, while curing, forms an interface with the outer shell where the second-type of concrete fuses with the surface; and at least one reinforcement structure comprising at least one of a metal rod and a reinforcement cage that extends through the core to an outside of the outer shell.

19. The composite construct, according to claim 18, further comprising surface features on the inner surface that increase the interface with the second type of concrete.

20. A composite construct comprising: a first outer shell, comprising a first type of concrete, having a lip on an outer edge and an arched void formed by a removable displacement piece defining an inner surface of the first outer shell; a second outer shell, comprising the first type of concrete, having a lip on an outer edge and an arched void formed by a removable displacement piece defining an inner surface of the second outer shell, and the lip on the first outer shell is joinable to the lip on the second outer shell; a concrete core formed within the arched voids of the joined first outer shell and the second outer shell, the concrete core comprising a second-type of concrete that, while curing, forms an interface with the inner surfaces of the first outer shell and the second outer shell where the second-type of concrete fuses with the inner surface of the first outer shell and with the surface of the second outer shell; and at least one reinforcement structure comprising at least one of a metal rod and a reinforcement cage disposed within the first arched void and the second arched void.

* * * * *